United States Patent [19]

Maier

[11] Patent Number: 4,837,494

[45] Date of Patent: Jun. 6, 1989

[54] GENERATOR AND RECHARGEABLE BATTERY SYSTEM FOR SKI

[76] Inventor: Gregory J. Maier, 8908 Wooden Bridge Rd., Potomac, Md. 20854

[21] Appl. No.: 212,614

[22] Filed: Jun. 28, 1988

[51] Int. Cl.[4] ..... A43B 7/02; A63C 11/00; H02K 5/00; H02J 7/00

[52] U.S. Cl. ..... 322/1; 219/211; 280/809; 310/75 R; 320/61

[58] Field of Search ..... 322/1; 320/2, 61; 280/809; 219/211; 310/75 B, 75 R, 75 A, 75 C

[56] References Cited

U.S. PATENT DOCUMENTS

| | | | |
|---|---|---|---|
| 2,088,029 | 7/1937 | McDermott | 310/156 |
| 2,299,762 | 10/1942 | McDermott | 322/1 X |
| 2,505,154 | 4/1950 | Smith | 280/809 X |
| 3,534,391 | 10/1970 | Bauer | 219/211 |
| 3,792,307 | 2/1974 | Baker | 315/77 |
| 3,859,496 | 1/1975 | Giese | 219/211 |
| 3,977,093 | 8/1976 | Santroch | 36/2.6 |
| 4,069,451 | 1/1978 | Rouse | 322/1 |
| 4,507,877 | 4/1985 | Vaccari et al. | 219/211 X |
| 4,546,650 | 10/1985 | Cameron | 280/809 X |
| 4,555,656 | 11/1985 | Ryan | 320/5 |
| 4,674,199 | 6/1987 | Lakic | 219/211 X |
| 4,697,359 | 10/1987 | Balbinot | 219/211 X |
| 4,697,360 | 10/1987 | Sartor | 36/2.6 |
| 4,782,602 | 11/1988 | Lakic | 219/211 X |

FOREIGN PATENT DOCUMENTS

| | | |
|---|---|---|
| 0207302 | 1/1987 | European Pat. Off. . |
| 3115122 | 7/1982 | Fed. Rep. of Germany . |

*Primary Examiner*—R. J. Hickey

*Attorney, Agent, or Firm*—Oblon, Spivak, McClelland, Maier, & Neustadt

[57] ABSTRACT

A generator and rechargeable battery system is disclosed for attachment to a ski having an electrically operable load. The invention comprises a rechargeable battery system in which the generator and/or battery can intermittently power a load such as a heating element of a ski boot. The rechargeable battery is detachable and may be recharged by the generator or in the home. Through the use of connecting wires, the generator and rechargeable battery system can be used to supply current to lights affixed to the ski and to power other electrical appliances.

30 Claims, 6 Drawing Sheets

GENERATOR AND RECHARGEABLE BATTERY SYSTEM FOR SKI

BACKGROUND OF THE INVENTION

1. Field of the Invention

The present invention relates to a generator and rechargeable battery system and more particularly to a generator and rechargeable battery system for use on a ski with an electrically operable load.

2. Discussion of the Background

The environment of the snow skier necessarily involves conditions of low temperature and is removed from the energy-derived comforts of the home. As a consequence, staying warm in such an environment is typically difficult and is at times nearly impossible. In particular, the skier's feet and toes are often exposed to extreme cold which can result in discomfort and even frostbite. Therefore, it can be seen that a ski equipped with a current generating mechanism could provide the skier with some of the heretofore missed comforts of home.

The prior art discloses heated boots and shoes which use a battery to power the heating elements involved. Examples of such devices are Santroch, U.S. Pat. No. 3,977,093, Balbinot, U.S. Pat. No. 4,697,359, Vaccari, U.S. Pat. No. 4,507,877, and Giese, U.S. Pat. No. 3,859,496. Difficulties arise with battery powered boots in that the heating elements use much power and the batteries are soon drained of electrical energy. As the batteries of the heating boots become drained of energy through use, the individual user is left unprotected from the cold. Therefore, a need for a recharging power source is apparent. With a recharging power source a skier would be able to remain comfortable in a frigid environment for an indefinite and extended amount of time.

Sartor, European Patent Office Publication No. 0207302A2, has proposed a ski manufactured with numerous solar cells which can generate electric current for use on an electrical load and which can store the current by means of a battery. However, Sartor's invention has a number of disadvantages. Since the solar cells are implanted into the surface of the ski at the time of manufacture, the invention is not adaptable to the conventional ski already in use. Furthermore, the solar cells cannot operate in the dark or in conditions of low light. Therefore, the use of the invention is optimized on clear, sunny days. Yet it is often on cold and overcast days that a skier is most in need of an energy source. Still another drawback of the solar cell ski is cost. The expensive nature of such a device would preclude it being used by a large number of skiers.

Solar celled ski boots have recently been introduced, Sartor, U.S. Pat. No. 4,697,360; however, little power can be generated through the solar cell and while negating the need for batteries, the expensive devices become worthless in low light conditions.

Small portable battery generator systems have a long history in pedal powered vehicles such as bicycles. The power provided by the legs of the bike rider is converted by the generator to electrical energy which typically is used to power a light mounted onto the bike's frame. Generator and rechargeable battery systems with their concomitant electronic circuitry are disclosed in Baker, U.S. Pat. No. 3,792,307, and Ryan, U.S. Pat. No. 4,555,656.

However, to date, no battery generator system has been devised that would utilize the kinetic an potential energy of a skier for purposes of generating an electrical current. The present invention utilizes the kinetic and potential energies of a skier by converting this energy by means of a rotating member which turns a drive shaft attached to a generator which is easily affixed to the ski. The electrical energy created can be used to power the heating elements in an electrically heated ski boot, to illuminate lighting fixtures attached to the ski, to power electrical appliances such as radios and tape players, and to recharge batteries which alternatively can be used to power the aforementioned electrical devices.

SUMMARY OF THE INVENTION

Accordingly, one object of this invention is to provide a novel generator and rechargeable battery system for use on a snow ski for the purpose of providing an electric current to the heating element of a ski boot.

Another object of the present invention is to provide a system for powering a light mounted onto a snow ski.

Yet another object of this invention is to provide a generator and rechargeable battery system which can be used to power the loads of any number of electrical devices such as a radio or tape player.

Still another object of the present invention is to provide a generator and rechargeable battery system which is light and compact and easily affixed to a conventional snow ski.

Briefly, these and other objects of the present invention are achieved by converting the kinetic and potential energy of the skier to an electric current. This is accomplished by means of a power roller which rotates as the ski moves along the ground thereby turning an axle which produces an electrical current by means of a generator which can be directed to charge the battery or power an electrical load.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
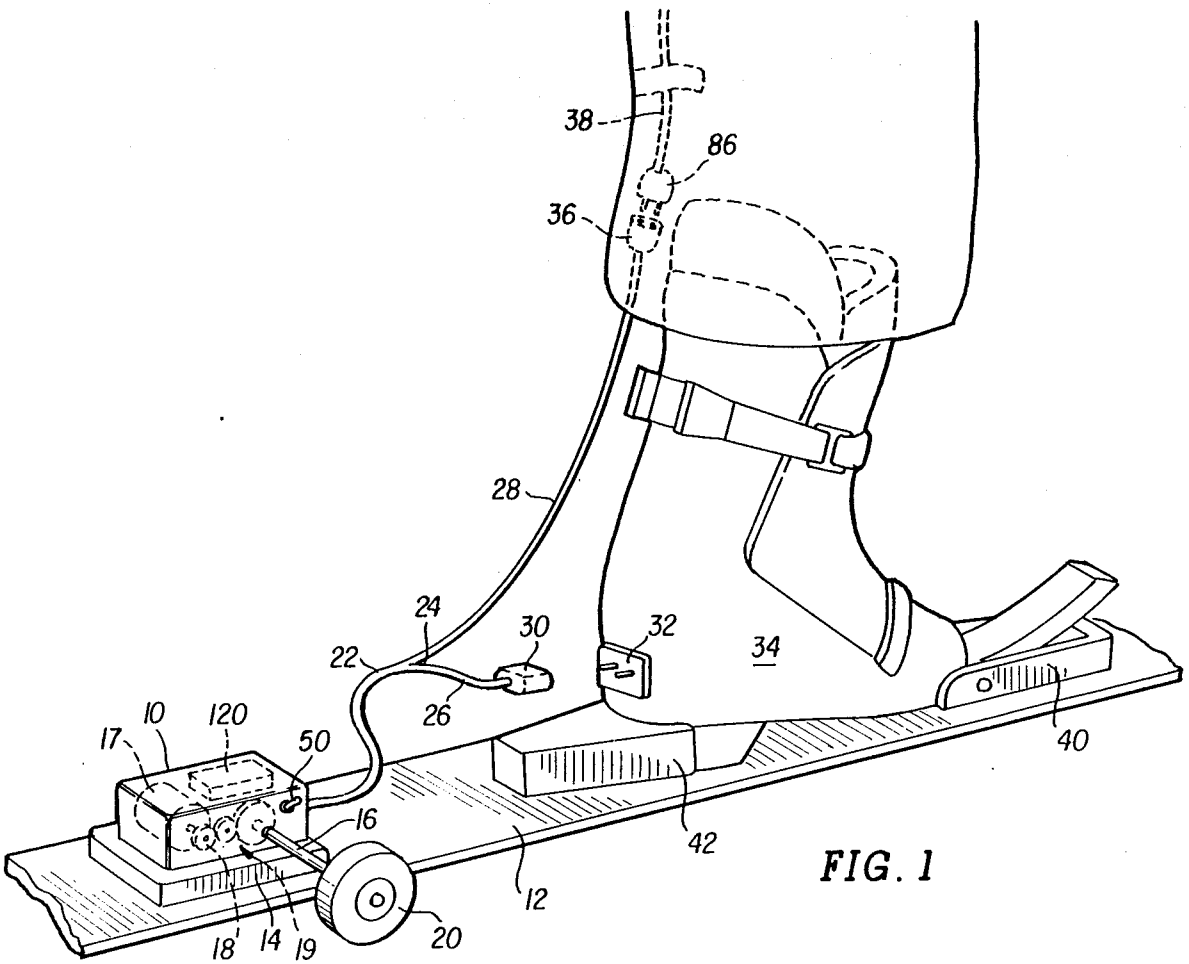
FIG. 1 is a perspective illustration of the generator structure of the present invention affixed to a snow ski showing the electrical interface with a heated boot.

Referring now to the drawings, wherein like reference numerals designate identical or corresponding parts throughout the several views, and more particularly to FIG. 1 thereof, a generator housing 10 is shown coupled to a conventional ski 12 by means of a mounting bracket 14.

The generator housing 10 contains a small, lightweight, high output generator of the type disclosed in McDermott U.S. Pat. No. 2,299,762, for example, or any suitable conventional equivalent generator. This generator is securely mounted within the housing and is sealed by means of watertight seals to prevent moisture from entering it. A removable power roller 20 is coupled to the drive shaft 16 for engaging the surface beneath the ski 12 and converting the linear motion of the ski to a rotary motion for ultimate conversion to electric power by the generator 17. As can be seen, drive shaft 16 rotates gear train 19 which turns generator mechanism 18 resulting in the generation of electricity by the generator 17.

The electrical output of the generator is supplied to an output cord 22 which is preferably permanently connected to the generator housing 10 at its input end. The output cord 22 includes a y-joint 24 where a short branch 26 and a long branch 28 are joined. The short branch 26 culminates in a conventional watertight connector 30, illustrated as a female connector, which is adapted to be connected in a secure manner to a two prong male connector 32 formed integrally with electrically heated ski boot 34.

The long branch 28 of the output cord 22 culminates in a similar watertight connector 36 which is adapted to interconnect with bridge cord 38, to be described in more detail subsequently.

It is noted that the electrically heated boot is mechanically coupled to the ski 12 by means of conventional toe and heel bindings 40 and 42, respectively.

Figure 2:
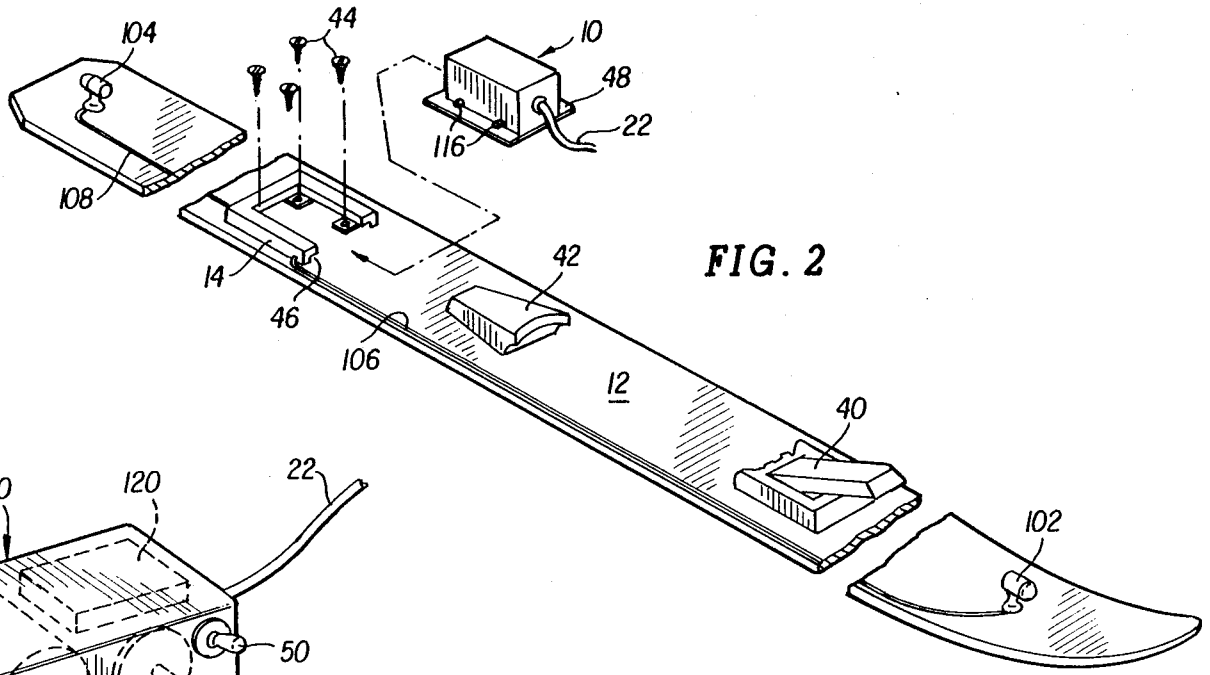
FIG. 2 is perspective illustration of a snow ski showing a structure for removably mounting the generator of the present invention.

Reference is now directed to FIG. 2 which illustrates the manner in which the generator housing 10 is secured to the ski 12. Specifically, the mounting bracket 14 is first connected to the ski 12 by conventional means such as screws 44. The mounting bracket includes an interior groove 46 which is shaped to receive a flange 48 formed around the base of the generator housing 10. The mounting bracket 14 is preferably formed of a resilient, flexible plastic material which does not lose its resiliency at low temperatures. Similarly, the flange 48 may also be formed of a tough, resilient plastic material. The same material may be used to form the entire generator housing 10. In operation, the generator is inserted into the mounting bracket so that the flange 48 interfits in the interior groove 46. The flange and groove structure are conventionally shaped so as to form a strong friction fit. By this friction fit mechanism, the generator housing may be easily placed on the ski or removed from the ski when not in use to prevent theft or damage.

It is noted that the same type of housing and mounting assembly may be used to secure a rechargeable battery to the ski that is not carrying the generator. Alternatively, one or two rechargeable batteries may be mounted to a skier's boots as disclosed in U.S. Pat. No. 3,859,496. The battery 120 may also be contained within the generator housing 10, as illustrated in FIG. 1. If the storage battery is mounted on the opposite ski from the generator, the battery and generator are coupled together via the bridge cord 38 described in more detail subsequently.

Figure 3:
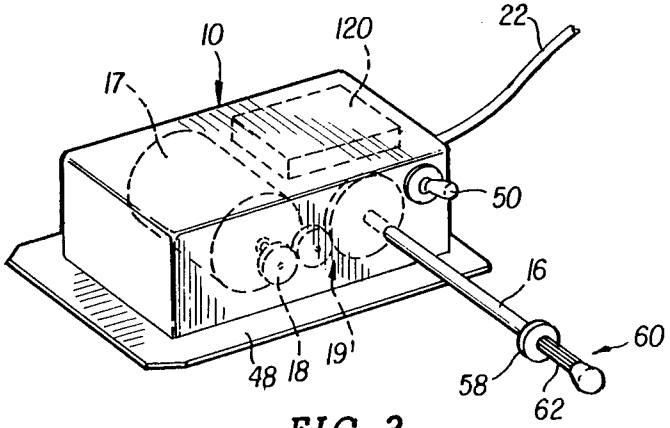
FIG. 3 is a perspective illustration of the generator housing illustrating particular details of the drive shaft.

Referring now to FIG. 3, the generator housing 10 is shown as including an on-off switch 50 which is used to switch on or off the electrical output of the generator 17. It is convenient to have an appropriate switch so that power delivered to the electrically heated boot 34 may be switched off on warm days or at other times when the user's feet do not need to be heated. As a alternative to the mechanically actuated on-off switch 50, a temperature responsive switching system can be incorporated into the generator housing. In this case, a temperature sensor 52 (illustrated in FIG. 6) is incorporated into the boot 34 to sense the temperature of boot heating element 54. When the temperature sensor 52 detects a predetermined temperature level, an appropriate output signal is applied over output line 56 and delivered to a conventional electrically responsive switch 57 (FIG. 11) which may replace the mechanical on-off switch 50, or be coupled in series with it.

Also illustrated in FIG. 3 is the drive shaft 16. This drive shaft is manufactured of a tough, resilient plastic material (e.g. a matrix/oriented fiber composite such as graphite/epoxy, carbon/epoxy, carbon/polyester, carbon/epoxy or fiberglass vinyl ester) so that it may flex to an extent when subjected to pressures, as would be the case when the skier is turning on the edge of the ski nearest the drive shaft 16. The drive shaft 16 includes a bushing 58 for positioning a power roller on the drive shaft and also includes a friction fastening structure 60 which is of conventional structure and is intended to permit a power roller to be installed or removed with convenience. The friction fit must, however, be strong enough to prevent the power roller from becoming disengaged during severe operating conditions. The portion of the drive shaft 16 carrying the friction fastener element includes splines 62 which interfit with appropriately shaped ribs 64 at the hub of suitable power rollers so that the rollers are firmly engaged in a nonslip fashion to the drive shaft 16. It is noted that while the shaft 16 is illustrated as extending outwardly from only one side of the generator housing 10, the shaft 16 may alternatively pass through the housing 10 and have a power roller attached at both ends.

Figure 4:
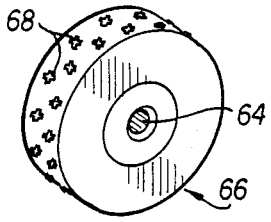
FIG. 4 is a perspective illustration of a power roller suitable for use on hard packed or icy surfaces.

Referring now to FIG. 4, a power roller 66 is shown which is adapted to be mechanically inserted on the friction fastener 60 for driving the generator 17. The power roller 66 is formed of a resilient plastic or rubber material that is deformable yet resilient so that it retains its round, cylindrical shape.

An open cell foamed polymer exemplifies the quality of material desired for the power roller. Examples include: cellular rubber open or closed cell, styrenebutadiene rubber with blowing agent; flexible cellular polymers, polyesterene (closed cell), polyethylene closed cell; flexible polyurethane. On the surface of the power roller 66 are embedded small spikes 68 made of metal or a hard plastic material that are adapted to engage hard packed snow or icy surfaces, and to prevent the power roller from sliding on such surfaces without rotating.

Figure 5:
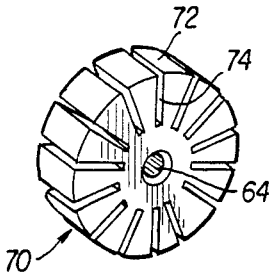
FIG. 5 is a perspective illustration of a power roller suitable for use in soft snow.

FIG. 5 illustrates another power roller 70 which is suitable for use in soft or unpacked snow. This power roller includes a series of semi-wedged shaped snow engaging feet 72 separated by spacer grooves 74. The design depicted enhances compressive capability while augmenting traction with the snow surface.

It is anticipated that the skier will review the skiing conditions most prevalent on the slopes when he reaches them. He will then select the power roller which will be most appropriate for those conditions. Clearly, other types of power rollers may also be adapted for use with the system for operation under conditions which are not suited to the two specific structures illustrated in FIGS. 4 and 5.

Figure 6:
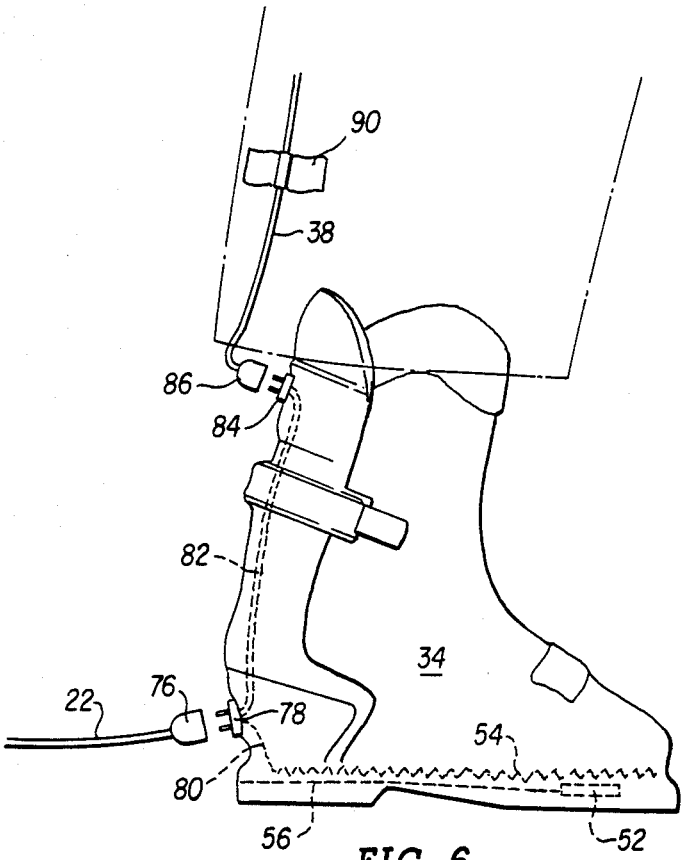
FIG. 6 is an illustration of an electrically heated boot illustrating an interface with the present invention.

Referring now to FIG. 6, a wiring structure is illustrated which is an alternative to that illustrated in FIG. 1. Specifically, the output cord 22 is shown having only a single female plug 76 coupled to a male plug 78 mounted onto a rear portion of the boot 34. A permanent interior electrical connection 80 is secured within the boot 34 to couple the plug 78 to heating element 54. Another electrical wire or cable 82 is mounted within the boot 34 to interconnect plug 78 with an upper male plug 84. The bridge cord 38 is connected to this upper plug. This alternative wiring structure requires further modification of the boot 34 to include more internal wiring. However, the resultant pattern of electrical wiring is somewhat simplified relative to that shown in FIG. 1. However, the FIG. 1 structure does not require such an extensive modification of the boot 34 and requires only one conventional input plug 32 in the boot 34.

Figure 7:
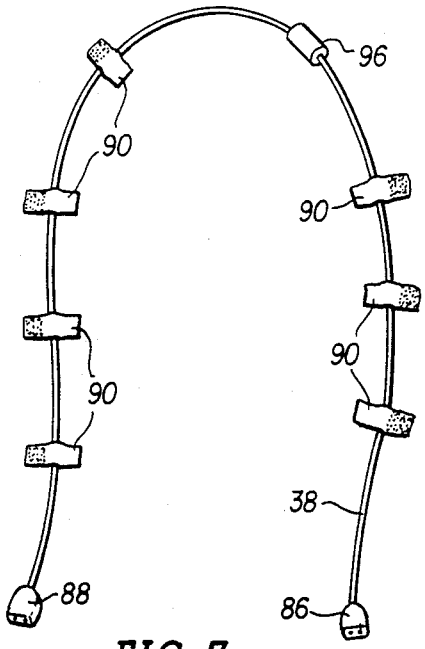
FIG. 7 is an illustration of the bridging cable of the invention.
Figure 9:
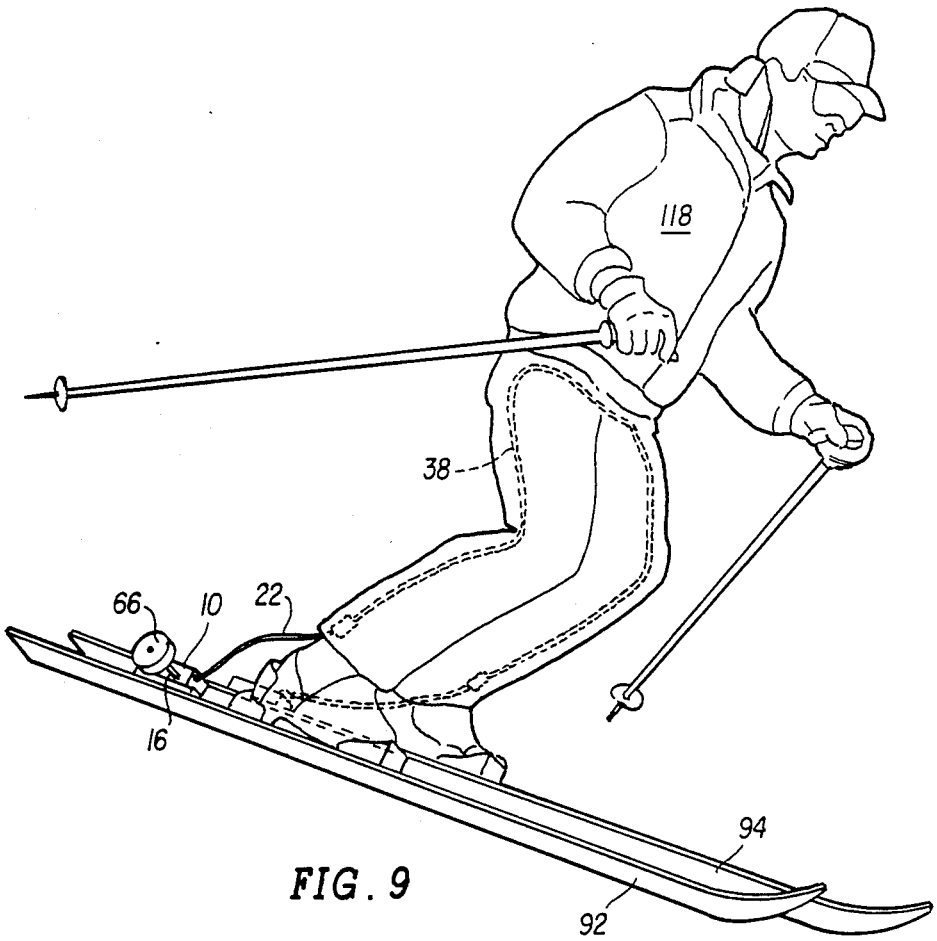
FIG. 9 is an illustration of the invention in use.

Reference is now directed to FIG. 7 which illustrates the bridge cord 38 in more detail. The bridge cord includes at its ends two female plugs 86 and 88. At suitable intervals along the bridge cord are mounted Velcro type or other equivalent fasteners 90 to permit the bridge cord to be coupled to the skier's clothing, as illustrated in FIG. 9. The bridge cord is necessitated by the fact that for economic reasons it will normally be desirable to have a generator mounted to only one ski. However, electric power must be supplied to both ski boots. This is accomplished by delivering electrical power from the generator mounted on the right ski 92 (FIG. 9) to the boot mounted to the left ski 94. The Velcro fasteners are suitable for quickly coupling the bridge cord to the skier's clothing.

The bridge cord may be mounted inside the skier's pants, as illustrated in FIGS. 1 and 9 or it may be mounted externally as illustrated in FIG. 6. Internal or external mounting is simply a matter of convenience and choice for the skier.

Figure 8:
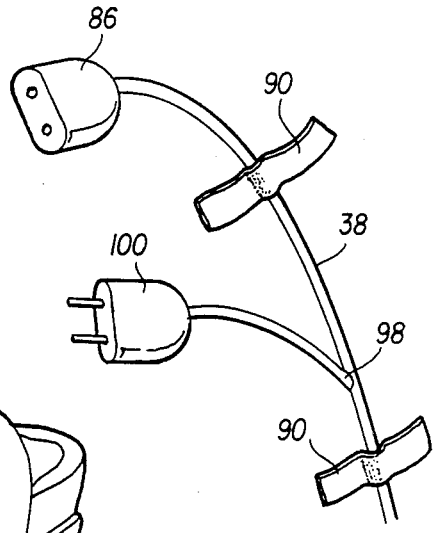
FIG. 8 is a further illustration of a modified bridging cable.

The bridge cord may also include an electrical outlet 96 so that the skier may connect other appliances such as a radio, tape player etc. to his generator 17. Similarly, the bridge cord may include a y-joint 98 as illustrated in FIG. 8 with a conventional electrical power plug or other output device 100 secured thereto.

Figure 10:
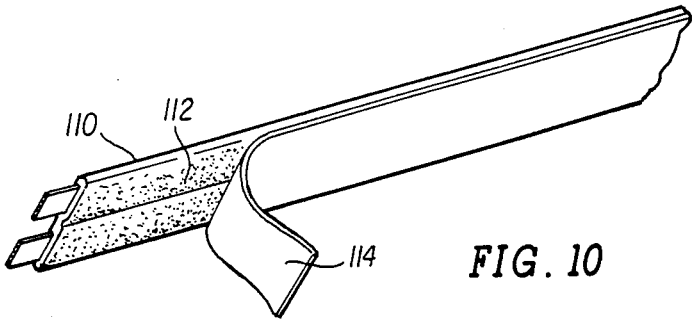
FIG. 10 is an illustration of adhesive stick wiring.

Referring again to FIG. 2, other electrical appliances may be connected to the ski's, as desired. FIG. 2 illustrates a front running light 102 and a rear running light 104 secured to the ski 12 and connected to the generator 17 by means of adhesive strip wiring 106 and 108 respectively. The adhesive strip wiring, illustrated in FIG. 10 is preferably formed of a flat, two conductor cable 110 having a ready-stick adhesive 112 placed on a lower surface thereof. A removable paper or plastic strip 114 is placed over the adhesive so that the cable may be sold or stored without concern over the adhesive. When the cable 110 is to be applied to a ski 12, the removable paper 114 is stripped away exposing the adhesive surface and permitting the cable to be directly attached to the surface of the ski.

When this wiring technique is used, it is preferable to include electrical contacts 116 on the flange portion 48 of the generator housing 10. These electrical contacts mate with other suitably formed electrical contacts positioned within the interior groove 46 of the mounting bracket 14 so that when the generator housing 10 is inserted into the groove, the contacts mate. The contacts 116 are electrically connected internally from the generator housing 10 to the generator 17 so that power is supplied through these contacts to the adhesive flat cable to power running lights 102 and 104. It will be apparent to those skilled in the art that the running lights 102 and 104 may be replaced with other conventional electrical appliances.

Figure 11:
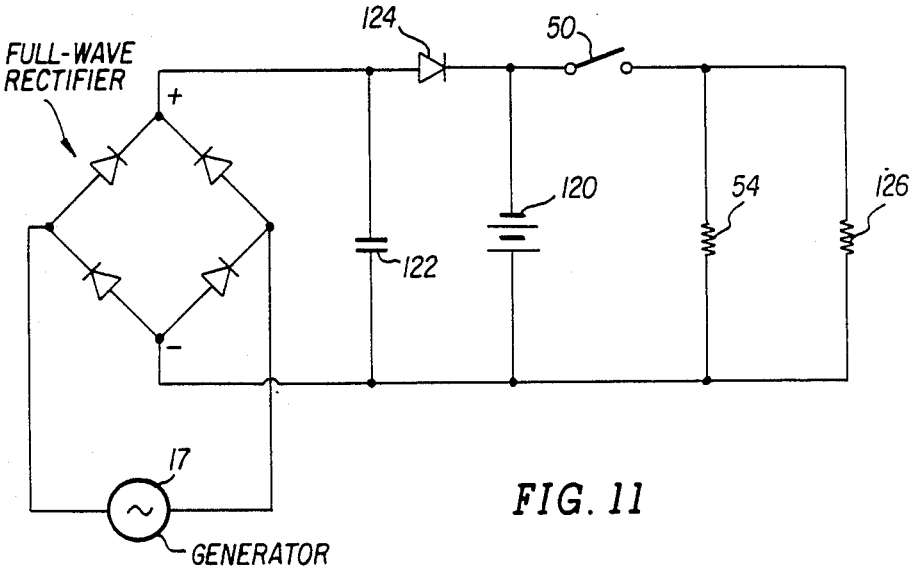
FIG. 11 is a schematic diagram of the electrical circuit of the invention.

Reference is now made to FIG. 11 which illustrates the electrical circuit of the present invention. The circuit is depicted as including generator 17 connected to a conventional full wave rectifier. A capacitor 122 is connected across the generator output for the purpose of minimizing any rippling effects in the rectification process. A diode 124 is interposed between the generator and storage battery 120 to insure that electrical current from the storage battery is not introduced to the generator. As can be seen, the storage battery is an additional power source which can supply the respective electrical loads with current and which can be supplied recharging current from the generator. The on-off switch 50 allows current to be supplied to the respective electrical loads during the on mode and prevents current from being circulated in the off mode. As can be seen from FIG. 11, the generator and rechargeable battery may be connected to the boot heating element 54 of each ski boot or to an electrical appliance 126.

In operation, a skier 118 first couples the bridge cord 38 to his ski pants, either externally or internally by using the fasteners 90. He then may mount the generator to one of his skis by inserting the flange 48 into the groove 46 within mounting bracket 14. The skier then makes the appropriate electrical connections to couple his heated boots 34 to the generator structure using output cord 22 to connect his right boot to the generator and coupling the output cord 22 to the bridge cord 38 to supply power to his left boot. The bridge cord provides complete freedom so that the skier may operate his skis in total disregard of the electrical connection attached to his pants.

In skiing, the power roller 66 or 70 engages the snow surface and rotates generator 17. In some instances, depending upon the way in which the skier is turning, the power roller may disengage itself from the snow. However, in this case, power is delivered to the boots or other electrical appliances by means of a conventional storage battery 120 housed either within the generator housing 10, or elsewhere, for example attached to the ski boots as shown in U.S. Pat. Nos. 3,859,496, 4,697,359 or 4,507,877. When the power roller engages the snow, the generator operates either by directly powering the electrically heated boots or by recharging the storage battery.

For the safety of the skier, it is noted that the various female and male connecting elements of the output cord and electrically heated ski boot interface in a water tight manner; however, the connection is easily separated by a light force so as to permit quick disconnection of the connecting elements should the skier's boots be released by the ski bindings, as often happens during falls on the ski slope.

Figure 12:
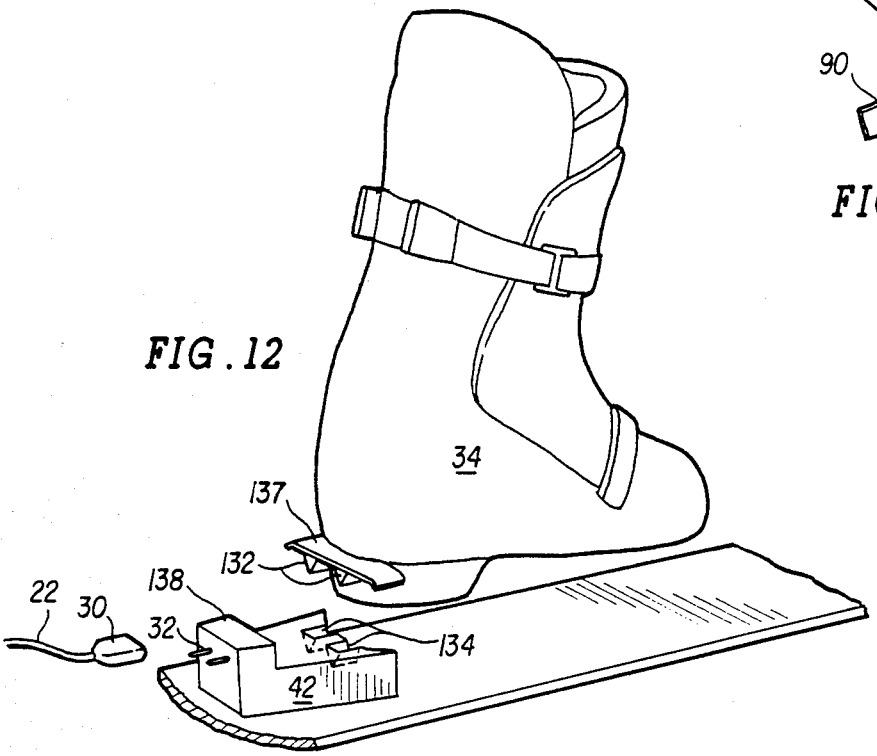
FIG. 12 is an illustration of an alternative electrical connector.

An alternative electrical connector which facilitates disconnection is illustrated in FIG. 12 which depicts an electrically heated ski boot having two wedge-shaped metal electrical contacts 132 protruding from the ski boot's heel. These wedge-shaped metal electrical contacts fit into the wedge-slots 134 of a connector station 136. A weather seal 137 seals out water and ice from contacts 132. The connector station 136 which houses wedge-slots 134 is attached to the top of heel binding 42. This connector station is provided with a male connector element 32 which interfaces with the female connecting element 30 of output cord 22. The connector station thereby receives electrical current which is channeled through the wedge shaped electrical contacts and onto the heating element in the ski boot. In this manner electrical energy is supplied to the ski boot while providing the skier with an effective disconnection means should his ski boots become detached from the ski bindings. This wedge connector structure described here is preferably combined with the internally wired boot structure illustrated in FIG. 6.

All patents mentioned in the Description of the Preferred Embodiment are to be considered as incorporated by reference into the present disclosure. Although the invention is specifically described in conjunction with snow skis, it is understood that it is suitable for use with any type of ski including water skis and grass skis. Furthermore the invention can be used with slalom boards and skate boards and other similar types of devices.

Obviously, numerous additional modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A ski generator network adapted to be used with conventional skis comprising:

water-tight housing means for housing a generator;

an electrical generator mounted within said housing for converting kinetic energy into electrical energy;

drive shaft means coupled to said generator for driving said generator, said drive shaft means protruding outwardly from said housing;

power roller means removably coupled to said drive shaft means for rotating said drive shaft means, said power roller means comprising a structure and material particularly suited to engage a surface that is stationary relative to said housing whereby said power roller is rotated by frictional engagement with said surface to rotate said drive shaft means; and mounting means adapted to be secured to a ski for removably mounting said housing to a ski.

2. A ski generator network as in claim 1, further comprising:

electrical outlet means coupled to said generator for supplying power to an electrical appliance.

3. A ski generator network as in claim 2, wherein said electrical connecting means further comprises:

an electrical lead having multiple connectors coupled thereto and further including fastening means for coupling said connector to the clothing of a skier.

4. A ski generator network as in claim 1, wherein said power roller means further comprises:

a resilient durable material for maintaining the round cylindrical shape of said power roller, said power roller being equipped with gripping means for engaging the surface, said power roller means having shaped ribs at its hub which interfit with splines located at the end of said drive shaft means.

5. A ski generator network as in claim 1, wherein said power roller means further comprises:

a resilient durable semi-wedged shape structure separated by spacer grooves, said power roller means having shaped ribs at its hub which interfit with splines located at the end of said drive shaft means.

6. A ski generator network as in claim 2, wherein said electrical outlet means further comprises:

an output cord for connecting said electrical generator to a electrically heated ski boot.

7. A ski generator network as in claim 6, wherein said output cord further comprises:

a y-joint which joins a short branch which connects to the electrically heated ski boot and a long branch which connects to a bridge cord.

8. A ski generator network as in claim 2, wherein said electrical outlet means further comprises:

a bridge cord connecting the generator on one ski with an electrical load on another ski, said bridge cord being equipped with securing means for fastening said bridge cord to a skier's pants, said bridge cord having a power outlet positioned at a location between said bridge cord's two ends for connecting an additional electrical load.

9. A ski generator network as in claim 1, further comprising:

a full wave rectifier connected to said generator, said generator being connected to an electrical contact;

a capacitor connected to said full wave rectifier;

an electrical appliance connected to said generator;

a storage battery connected to said generator, said storage battery being capable of being recharged by said generator, said storage battery being capable of supplying current to electrical loads;

a diode located between said generator and said storage battery to prevent current from said storage battery from being introduced to said generator;

an on-off switch to prevent current from being emitted from said water-tight housing means of said generator in the off mode and for providing current to electrical loads located outside said water-tight housing means during the on mode.

10. A ski generator network as in claim 2, further comprising:

a connector station having attaching means which attach to the heel bindings of said ski, said connector station having wedge slots, said connector station being electrically connected to said generator.

11. A ski generator network as in claim 10, further comprising:

an electrically heated ski boot having two wedge-shaped metal electrical contacts attached to its heel, said wedge-shaped metal electrical contacts being shaped for interfacing with said wedge slots of said connector station, said wedge-shaped metal electrical contacts providing means for supplying electrical current to said electrically heated ski boot.

12. A ski generator network as in claim 1, further comprising:

an electrically responsive switch connected between said electrical generator and an electrically heated ski boot, said ski boot being equipped with temperature sensing means, capable of detecting a predetermined temperature level, which sends a signal to said electrically responsive switch to open said switch when the detected temperature is above the predetermined level and to close said electrically responsive switch when the detected temperature is below the predetermined level.

13. A ski generator network comprising:

an electrical generator assembly adapted to be coupled to a snow ski;

a drive shaft coupled to said generator;

a power roller removably mounted to said drive shaft for rotating the same;

said power roller adapted to engage a surface being traversed by said ski whereby rotary motion is imparted through said drive shaft to said generator;

output cable means coupled to said generator for supplying output power;

electrically heated ski boot means adapted to be coupled to said ski in proximity to said generator means;

said ski boot including electrical circuit means for interconnection with said cable means whereby electrical power may be supplied by said generator to said electrically heated ski boot.

14. A ski generator network as in claim 13, further comprising running lights coupled to said ski and interconnected with said generator system, whereby said generator supplies power to said running lights.

15. A ski generator network as in claim 13, further comprising:

rechargeable storage battery means coupled to said generator for receiving and storing electrical power produced by said generator.

16. A ski generator network as in claim 13, further comprising:

a connector station having attaching means which attach to the heel bindings of said ski, said connector station having wedge slots, said connector station being electrically connected to said generator.

17. A ski generator network as in claim 16, further comprising:

an electrically heated ski boot having two wedge-shaped metal electrical contacts attached to its heel, said wedge-shaped metal electrical contacts being shaped for interfacing with said wedge slots of said connector station, said wedge-shaped metal electrical contacts providing means for supplying electrical current to said electrically heated ski boot.

18. A ski generator network adapted to be used on a conventional ski for powering of two electricallyheated ski boots and for powering other electrically operable loads, comprising:

a mounting bracket with an interior groove, affixing means for affixing said mounting bracket to said snow ski, an electrical generator having a generator mechanism for generating an electrical current, generator housing insulating said electrical generator, a flange connected to and supporting said gear housing and which can be inserted in and removed from said interior groove of the mounting bracket, a rechargeable and removable storage battery located in the interior of said generator housing electrically connected to said electrical generator, a drive shaft horizontally extending away from said generator housing and located above and parallel to the surface of said ski, one end of said drive shaft being connected to a gear train located in said generator housing, said gear train connecting to the generator mechanism of said electrical generator, a power roller connected to the other end of said drive shaft said power roller making contact with the skiing surface, an output cord connecting said electrical generator to one of said electrically heated ski boots, a bridge cord connected at one end to said electrical generator and connected at its other end to the second of said electrically heated ski boots.

19. A network according to claim 18, wherein:

said output cord comprises a y-joint dividing said output cord into a short branch which connects to said first electrically heated ski boot and a long branch which connects to one end of said bridge cord.

20. A network according to claim 18, wherein:

said storage battery can be charged by said electrical generator in one instance and can be removed to be charged in a home environment in another instance.

21. A network according to claim 18, wherein:

said power roller has a hub having ribs which interfit with splines located at the end of said drive shaft.

22. A network according to claim 18, wherein:

said bridge cord further comprises fastening means located at varying locations on said bridge cord to enable attachment of said bridge cord to a skier's pants.

23. A network according to claim 18, wherein:

said bridge cord further comprises a power outlet located along the length of said bridge cord, said power outlet providing a means for interfacing with other electrical appliances.

24. A network according to claim 18, further comprising:

an electrical contact located at the exterior of said generator housing said electrical contact being electrically connected to said electrical generator.

25. A network according to claim 18, further comprising:

adhesive strip wiring connected to said electrical contact at one end and connected to electrical lights mounted onto the ski at the other end.

26. A network according to claim 18, further comprising:

a switch located on the generator housing and electrically connected to said electrical generator.

27. A network as in claim 18, further comprising a full wave rectifier connected to said generator, a small capacitor connected to said generator, an electrical appliance connected to said generator, said storage battery connected to said generator, said storage being capable of being recharged by said generator, said storage being capable of supplying current to electrical loads;

a diode located between said generator and said storage battery to prevent current from said storage battery from being introduced to said generator.

28. A network as in claim 18, further comprising:

an electrically responsive switch connected between said generator and said electrically heated ski boots, said ski boot being equipped with temperature sensing means, capable of detecting a predetermined temperature level, which sends a signal to said electrically responsive switch to open said switch when the detected temperature is above the predetermined temperature level and to close said electrically responsive switch when the detected temperature is below the predetermined temperature level.

29. A ski generator network as in claim 18, further comprising:

a connector station having attaching means which attach to the heel bindings of said ski, said connector station having wedge slots, said connector station being electrically connected to said generator.

30. A ski generator network as in claim 29, further comprising:

an electrically heated ski boot having two wedge-shaped metal electrical contacts attached to its heel, said wedge-shaped metal electrical contacts being shaped for interfacing with said wedge slots of said connector station, said wedge-shaped metal electrical contacts providing means for supplying electrical current to said electrically heated ski boot.

* * * * *